US007958652B2

(12) United States Patent
Huffman et al.

(10) Patent No.: US 7,958,652 B2
(45) Date of Patent: Jun. 14, 2011

(54) EXTRACTION CLEANING WITH PLENUM AND AIR OUTLETS FACILITATING AIR FLOW DRYING

(75) Inventors: Eric C. Huffman, Lowell, MI (US); Kenneth M. Lenkiewicz, Grand Rapids, MI (US)

(73) Assignee: BISSELL Homecare Inc., Grand Rapids, MI (US)

( * ) Notice: Subject to any disclaimer, the term of this patent is extended or adjusted under 35 U.S.C. 154(b) by 498 days.

(21) Appl. No.: 11/677,323

(22) Filed: Feb. 21, 2007

(65) Prior Publication Data

US 2007/0130721 A1 Jun. 14, 2007

Related U.S. Application Data

(63) Continuation-in-part of application No. 11/275,471, filed on Jan. 6, 2006, now Pat. No. 7,793,385.

(60) Provisional application No. 60/593,358, filed on Jan. 7, 2005.

(51) Int. Cl.
*F26B 5/00* (2006.01)

(52) U.S. Cl. ..... 34/89; 34/201; 34/210; 34/239; 34/638; 15/320; 15/339; 141/200; 347/36; 347/89; 95/237; 96/50

(58) Field of Classification Search ..... 34/89, 201, 34/210, 239, 638; 15/320, 339; 141/200; 347/36, 89; 95/237; 96/50
See application file for complete search history.

(56) References Cited

U.S. PATENT DOCUMENTS

| | | | | | |
|---|---|---|---|---|---|
| 3,663,984 | A | * | 5/1972 | Anthony et al. | 15/321 |
| 3,675,563 | A | * | 7/1972 | Metreaud | 396/624 |
| 3,764,074 | A | * | 10/1973 | James | 239/318 |
| 3,778,969 | A | * | 12/1973 | Sudduth | 95/237 |
| 4,608,017 | A | * | 8/1986 | Sadohara | 433/81 |
| 4,751,887 | A | * | 6/1988 | Terry et al. | 588/321 |
| 4,860,523 | A | * | 8/1989 | Teteishi et al. | 53/512 |
| 5,237,720 | A | | 8/1993 | Blase et al. | |
| 5,289,610 | A | * | 3/1994 | Monson | 15/320 |
| 5,307,746 | A | * | 5/1994 | Khinkis et al. | 110/245 |
| 5,430,910 | A | * | 7/1995 | Wiley | 15/321 |
| 5,507,068 | A | * | 4/1996 | Fan et al. | 15/320 |
| 5,548,905 | A | | 8/1996 | Kuma et al. | |
| 5,587,021 | A | * | 12/1996 | Hoersch et al. | 134/1 |
| 5,813,086 | A | * | 9/1998 | Ueno et al. | 15/320 |
| 5,979,013 | A | | 11/1999 | Beckey et al. | |
| 5,979,669 | A | * | 11/1999 | Kitajima et al. | 210/455 |
| 5,992,051 | A | | 11/1999 | Salehibakhsh | |
| 5,996,811 | A | * | 12/1999 | Kitajima et al. | 210/488 |
| 6,052,861 | A | * | 4/2000 | Keller | 15/321 |
| 6,131,237 | A | | 10/2000 | Kasper et al. | |

(Continued)

FOREIGN PATENT DOCUMENTS

EP 404278 A2 * 12/1990

(Continued)

*Primary Examiner* — Stephen M. Gravini
(74) *Attorney, Agent, or Firm* — McGarry Bair PC

(57) ABSTRACT

A portable cleaning apparatus comprises a base module for movement along a surface and a plenum. The base module comprises a base housing enclosing a fan for moving air through the housing from the interior of the housing to the exterior of the housing through an exhaust outlet in the housing. The plenum fluidly communicates at one end with the exhaust outlet and at another end with at least one plenum outlet opening adjacent the surface to direct air exhausted from the housing interior along the surface.

5 Claims, 15 Drawing Sheets

U.S. PATENT DOCUMENTS

| | | | | | |
|---|---|---|---|---|---|
| 6,159,361 | A * | 12/2000 | Lapointe | 210/121 |
| 6,162,356 | A * | 12/2000 | Ikeda et al. | 210/198.2 |
| 6,167,587 | B1 * | 1/2001 | Kasper et al. | 15/320 |
| 6,170,671 | B1 * | 1/2001 | Kitajima et al. | 210/455 |
| 6,220,453 | B1 * | 4/2001 | Kitajima et al. | 210/406 |
| 6,230,362 | B1 * | 5/2001 | Kasper et al. | 15/320 |
| 6,286,181 | B1 * | 9/2001 | Kasper et al. | 15/320 |
| 6,298,578 | B1 | 10/2001 | Frampton | |
| 6,345,411 | B1 * | 2/2002 | Kato et al. | 15/412 |
| 6,412,141 | B2 * | 7/2002 | Kasper et al. | 15/320 |
| 6,438,793 | B1 * | 8/2002 | Miner et al. | 15/320 |
| 6,467,122 | B2 | 10/2002 | Lenkiewicz et al. | |
| 6,505,379 | B2 | 1/2003 | Keller | |
| 6,560,817 | B2 * | 5/2003 | Deiterman et al. | 15/320 |
| 6,674,984 | B2 * | 1/2004 | Oooka | 430/117.4 |
| 6,693,255 | B2 * | 2/2004 | Freiwald et al. | 219/121.68 |
| 6,926,796 | B1 * | 8/2005 | Nishida et al. | 156/312 |
| 7,000,286 | B2 * | 2/2006 | Wang | 15/320 |
| 7,051,773 | B2 * | 5/2006 | Watanabe et al. | 141/251 |
| RE39,304 | E * | 9/2006 | Kasen et al. | 15/320 |
| RE39,339 | E * | 10/2006 | Andersen et al. | 106/206.1 |
| 7,179,062 | B1 * | 2/2007 | Drevitson et al. | 417/234 |
| 7,302,733 | B2 * | 12/2007 | Rau et al. | 15/320 |
| 7,308,913 | B2 * | 12/2007 | Watanabe et al. | 141/7 |
| 7,356,875 | B2 * | 4/2008 | Abdallah et al. | 15/345 |
| 7,410,249 | B2 * | 8/2008 | Inoue | 347/89 |
| 7,475,712 | B2 * | 1/2009 | McDowell | 15/320 |
| 7,625,435 | B2 * | 12/2009 | Dooley | 96/50 |
| 2001/0000830 | A1 * | 5/2001 | Kasper et al. | 15/320 |
| 2002/0134770 | A1 * | 9/2002 | Freiwald et al. | 219/121.68 |
| 2002/0191988 | A1 * | 12/2002 | Oooka | 399/237 |
| 2004/0250878 | A1 * | 12/2004 | Watanabe et al. | 141/200 |
| 2005/0066830 | A1 * | 3/2005 | Miyagawa et al. | 101/463.1 |
| 2005/0155706 | A1 * | 7/2005 | Nishida et al. | 156/312 |
| 2005/0166358 | A1 * | 8/2005 | Lee et al. | 15/320 |
| 2005/0208774 | A1 * | 9/2005 | Fukunaga et al. | 438/745 |
| 2005/0224974 | A1 * | 10/2005 | Nishida et al. | 257/737 |
| 2006/0066697 | A1 * | 3/2006 | Inoue | 347/89 |
| 2006/0180239 | A1 * | 8/2006 | Watanabe et al. | 141/200 |
| 2007/0013067 | A1 * | 1/2007 | Nishida et al. | 257/737 |
| 2007/0056136 | A1 | 3/2007 | Stephens et al. | |
| 2007/0089262 | A1 * | 4/2007 | Drevitson et al. | 15/339 |
| 2007/0119016 | A1 * | 5/2007 | Drevitson et al. | 15/339 |
| 2007/0130721 | A1 * | 6/2007 | Huffman et al. | 15/320 |
| 2008/0072395 | A1 * | 3/2008 | McDowell | 15/320 |
| 2008/0072755 | A1 * | 3/2008 | Dooley | 96/15 |
| 2008/0084463 | A1 * | 4/2008 | Kawase | 347/89 |
| 2008/0158294 | A1 * | 7/2008 | Katoh | 347/36 |
| 2009/0090021 | A1 * | 4/2009 | Huffman et al. | 34/359 |
| 2009/0142785 | A1 * | 6/2009 | Osato et al. | 435/15 |

FOREIGN PATENT DOCUMENTS

| | | | |
|---|---|---|---|
| EP | 1014020 | A1 * | 6/2000 |
| JP | 58190509 | A * | 11/1983 |
| JP | 59182368 | A * | 10/1984 |
| JP | 60065300 | A * | 4/1985 |
| JP | 60187800 | A * | 9/1985 |
| JP | 61072946 | A * | 4/1986 |
| JP | 61161110 | A * | 7/1986 |
| JP | 61178013 | A * | 8/1986 |
| JP | 62279826 | A * | 12/1987 |
| JP | 63256101 | A * | 10/1988 |
| JP | 63270524 | A * | 11/1988 |
| JP | 63278505 | A * | 11/1988 |
| JP | 63286770 | A * | 11/1988 |
| JP | 01297204 | A * | 11/1989 |
| JP | 02213746 | A * | 8/1990 |
| JP | 02296703 | A * | 12/1990 |
| JP | 03011758 | A * | 1/1991 |
| JP | 03041957 | A * | 2/1991 |
| JP | 03076946 | A * | 4/1991 |
| JP | 03077629 | A * | 4/1991 |
| JP | 03219565 | A * | 9/1991 |
| JP | 03238080 | A * | 10/1991 |
| JP | 04041998 | A * | 2/1992 |
| JP | 04098058 | A * | 3/1992 |
| JP | 04187298 | A * | 7/1992 |
| JP | 05187736 | A * | 7/1993 |
| JP | 08010524 | A * | 1/1996 |
| JP | 08118680 | A * | 5/1996 |
| JP | 09103661 | A * | 4/1997 |
| JP | 09236095 | A * | 9/1997 |
| JP | 10072100 | A * | 3/1998 |
| JP | 10101115 | A * | 4/1998 |
| JP | 11082360 | A * | 3/1999 |
| JP | 11334094 | A * | 12/1999 |
| JP | 2000107509 | A * | 4/2000 |
| JP | 2000167549 | A * | 6/2000 |
| JP | 2000234349 | A * | 8/2000 |
| JP | 2001062221 | A * | 3/2001 |
| JP | 2002103262 | A * | 4/2002 |
| JP | 2002336731 | A * | 11/2002 |
| JP | 2003269399 | A * | 9/2003 |
| JP | 2004090432 | A * | 3/2004 |
| JP | 2005090005 | A * | 4/2005 |
| JP | 2005161115 | A * | 6/2005 |
| JP | 2006116495 | A * | 5/2006 |
| JP | 2008093854 | A * | 4/2008 |
| WO | WO 8503853 | A1 * | 9/1985 |

* cited by examiner

EXTRACTION CLEANING WITH PLENUM AND AIR OUTLETS FACILITATING AIR FLOW DRYING

CROSS-REFERENCE TO RELATED APPLICATION

This application is a continuation-in-part of U.S. application Ser. No. 11/275,471, filed Jan. 6, 2006, now U.S. Pat. No. 7,793,385, issued Sep. 14, 2010, and claims the benefit of U.S. provisional application Ser. No. 60/593,358, filed Jan. 7, 2005, which are incorporated herein in their entirety.

BACKGROUND OF THE INVENTION

1. Field of the Invention

This invention relates to extraction cleaning. In one of its aspects, the invention relates to an extraction cleaning machine with drying of a surface to be cleaned. In another of its aspects, the invention relates to an upright extraction cleaning machine with drying of a surface to be cleaned. In another of its aspects, the invention relates to extraction cleaning with air flow drying of a surface to be cleaned. In another of its aspects, the invention relates to extraction cleaning with air flow drying of a surface to be cleaned facilitated by a plenum and air outlet openings.

2. Description of the Related Art

Upright extraction cleaning machines have been used for removing dirt from surfaces such as carpeting and hard floors. The known extraction cleaning machines can be in the form of a canister-type unit, as disclosed in U.S. Pat. No. 5,237,720 to Blase et al., or an upright unit, as disclosed in U.S. Pat. No. 6,131,237 to Kasper et al.

Either type of unit contains a fluid delivery system for depositing a quantity of cleaning solution on the surface to be cleaned. The cleaning solution dissolves the dirt, removes the dirt from the surface, and places the dirt in suspension, which aids in the vacuum removal of the dirt from the surface. Although the cleaning solution and suspended dirt are removed from the surface, the surface remains wet, and cannot typically be used until it dries. The drying time may be significant, perhaps several hours in duration, depending on the surface type. For carpeted surfaces, the thickness of the carpet pile, the hydrophilic properties of the carpet fibers, the degree of saturation of the carpet, the ambient air relative humidity and circulation, and the like all affect the speed at which the carpet dries. While the surface is drying, furniture that has been removed cannot be replaced, traffic must be diverted to other locations or interrupted, and the area cannot be used, which may cause unacceptable interruptions in necessary activities, such as commercial, educational, or institutional activities.

U.S. Pat. No. 5,813,086 to Ueno et al. discloses a cleaner comprising a suction nozzle for removing excess cleaning liquid from the carpet and an adjacently located blower nozzle which delivers heated air downwardly onto the carpet after the suction nozzle has removed the excess liquid.

U.S. Pat. No. 6,505,379 to Keller discloses a carpet extractor head fluidly connected to an external vacuum and pressurized air source, wherein drying air is delivered through an interior conduit in the head to the carpet and is evacuated through a conduit surrounding the interior conduit.

U.S. Pat. No. 6,298,578 to Frampton discloses a mobile water evacuating and surface drying device having a blower nozzle to deliver heated air downwardly onto the surface after a suction nozzle has removed excess liquid.

U.S. Pat. No. 5,992,051 to Salehibakhsh discloses a carpet drying apparatus comprising a hollow plate fluidly connected to a regularly-spaced array of elongated, hollow needles which are inserted into a carpet to deliver compressed air through the needles and into the carpet.

U.S. Pat. No. 5,548,905 to Kuma et al. discloses a stationary conveyor belt apparatus for drying mats, carpet pieces, and the like that are moved on a moving belt through a vacuum and compressed air drying station. The vacuum and compressed air nozzles are in contact with the mat/carpet piece to draw air through the carpet.

SUMMARY OF THE INVENTION

A portable cleaning apparatus includes a base module with a suction nozzle, and a base housing module housing with an exhaust air outlet for discharging pressurized air. The suction nozzle includes an opening located within the base module housing for extraction of air and liquid from a surface. A plenum is coupled with an exterior of the base module housing, and includes a plenum outlet opening located externally of the base module housing.

A method of drying a surface comprises selecting the portable cleaning apparatus, removing a mixture of air and liquid from the surface by applying suction to the surface through the suction nozzle while moving the base module along a first direction, separating the air and liquid, pressurizing the separated air, and exhausting the pressurized air through the exhaust outlet into the plenum, thence through the plenum outlet opening in a second direction transverse to the first direction along the surface away from the base module.

Preferably, the pressurized air is exhausted along the surface from a location spaced away from the suction nozzle.

In one embodiment, the pressurized air is passed toward the surface through the bottom of the base housing before being exhausted laterally along the surface.

In another embodiment, the air is heated by directing the air over a heat-generating power component, and exhausting the heated air along the surface.

In yet another embodiment, the pressurized air is separated into at least two streams wherein the exhausting step includes directing the two streams of pressurized air along two substantially opposite directions generally collinear with the second direction.

DESCRIPTION OF AN EMBODIMENT OF THE INVENTION

Figure 1:
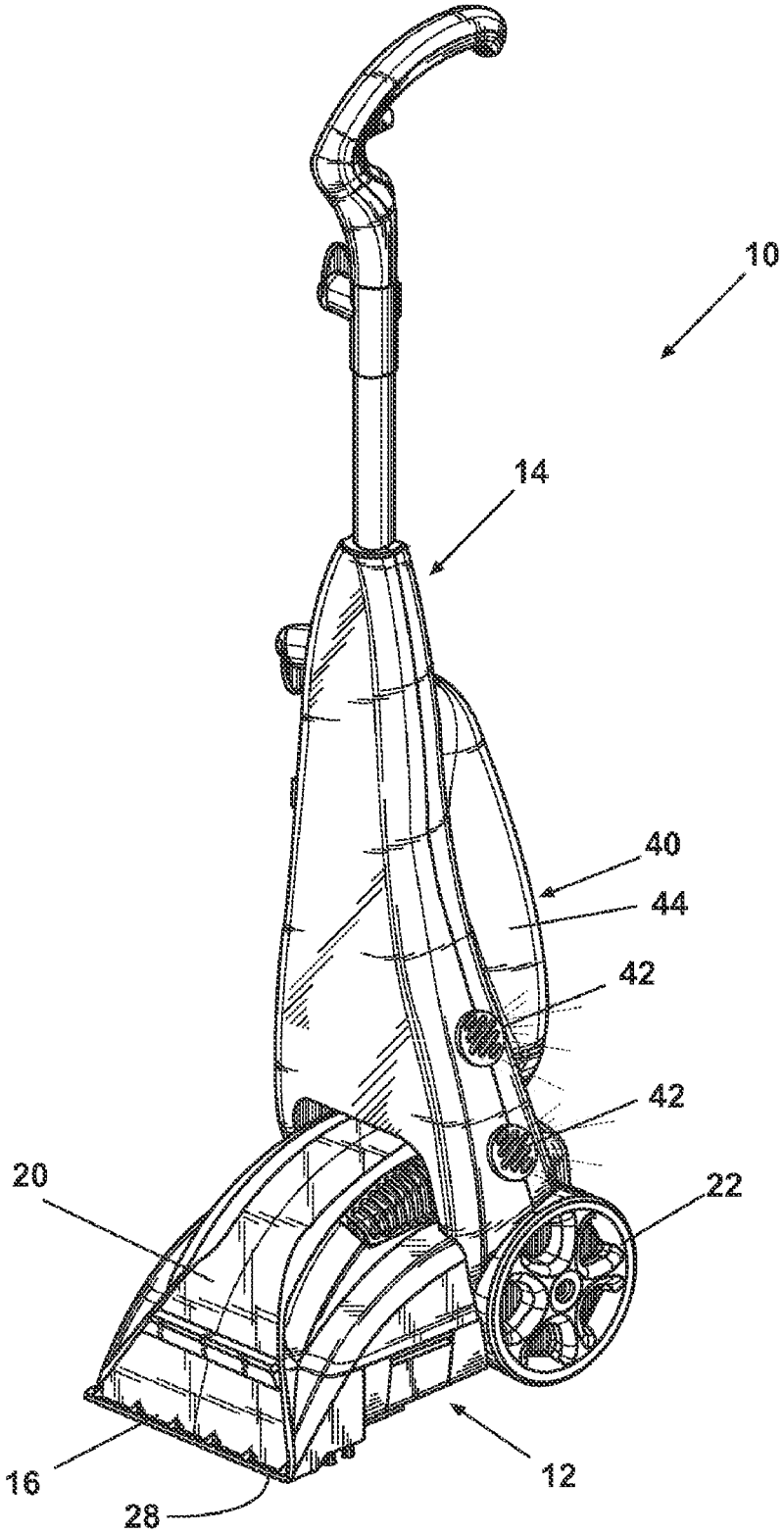
FIG. 1 is a perspective view of an upright extraction cleaning machine comprising a base module and a handle assembly, and a first embodiment of a blower assembly according to the invention.

Referring now to the drawings and to FIG. 1 in particular, a first embodiment of an extraction cleaning machine 10 according to the invention is illustrated. The machine 10 is a portable surface cleaning apparatus including a base module 12 adapted with wheels 22 to roll across a surface to be cleaned, and an upright handle assembly 14 pivotally mounted to a rear portion of the base module 12. The invention is described and illustrated herein with respect to an embodiment comprising an upright extraction cleaning machine, although the invention can also be utilized in a canister-type cleaning machine. The upright extraction cleaning machine 10 is a generally well-known device comprising several of the features and operations described in U.S. Pat. No. 6,467,122 to Lenkiewicz et al., which is incorporated herein by reference in its entirety. Such well-known features and operations will not be described in detail herein, except as otherwise necessary for a complete understanding of the invention.

Figure 2:
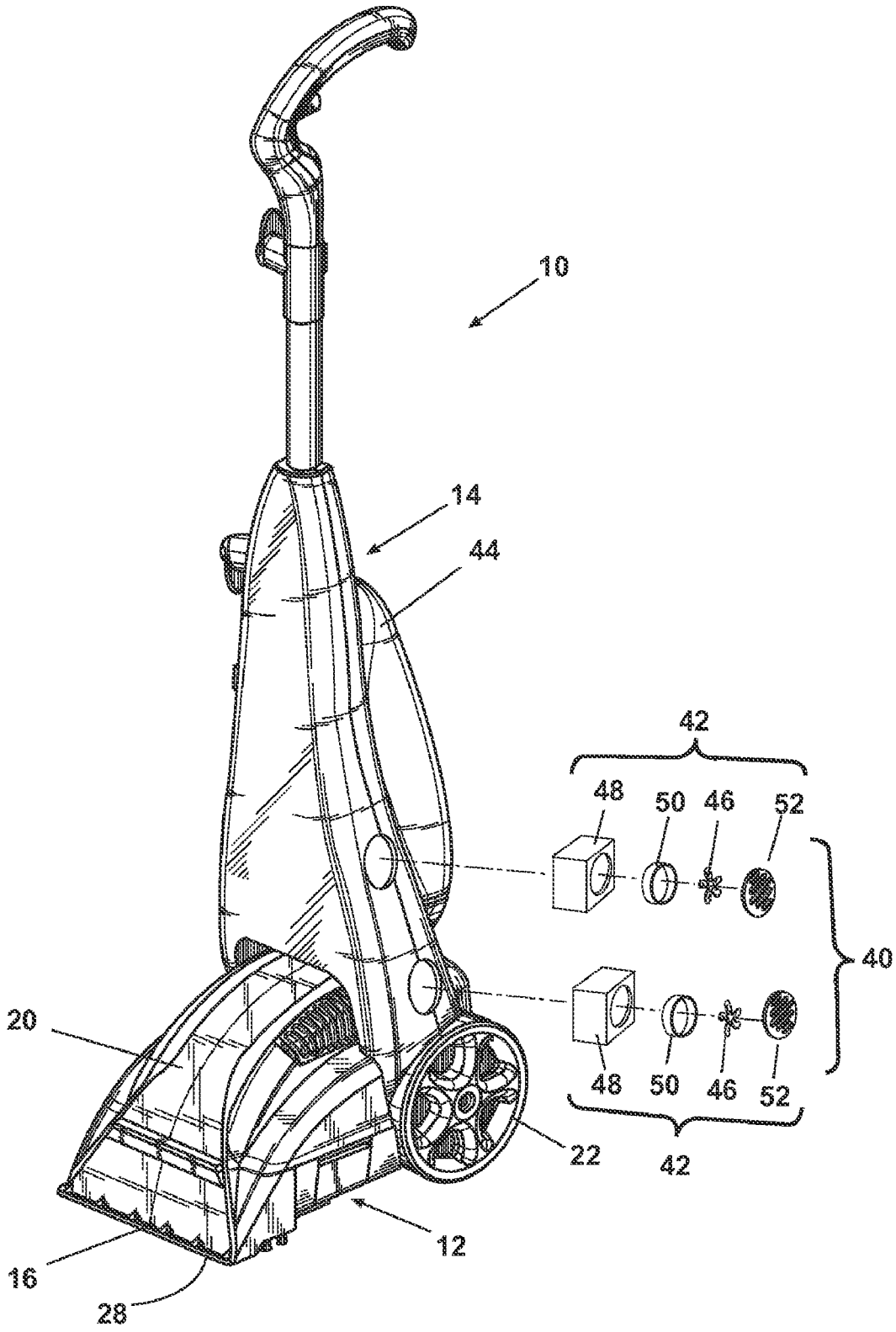
FIG. 2 is a partially exploded view of the upright extraction cleaning machine of FIG. 1 illustrating an assemblage of blowers.

As illustrated in FIGS. 1 and 2, the base module 12 includes a housing 20 having a front portion 16. The housing 20 forms an enclosure for a motor 24 operating a well-known vacuum system 30 for vacuuming liquid from the surface to be cleaned through a vacuum inlet 28, an agitation assembly 26 (FIG. 5), a liquid delivery system comprising a pair of outlet nozzles (not shown) for applying liquid to the surface, liquid reservoirs, and the like.

The embodiment illustrated in FIGS. 1 and 2 comprises a blower assembly 40 mounted to the handle assembly 14, preferably along a rear portion thereof. The blower assembly 40 comprises a plurality of blowers 42 mounted in a blower housing 44. Preferably, the blowers 42 are high-flow blowers capable of a relatively high air flow therethrough. The greater the airflow, the better, however, suitable air flow for the purposes described herein range from 20-100 cubic feet per minute, typically about 30 cubic feet per minute. FIGS. 1 and 2 illustrate a pair of blowers 42 mounted in one lateral wall of the blower housing 44 for delivery of air laterally away from the extraction cleaning machine 10 in a first direction. It will be understood that an identical pair of blowers 42 is mounted in the opposed lateral wall of the blower housing 44 for delivery of air laterally away from the extraction cleaning machine 10 in a second, opposed direction. The first and second directions are transverse to the movement of the extraction cleaning machine 10 along the floor during the cleaning process. Each blower 42 comprises a fan 46 rotatably mounted in a fan housing 48. The fan 46 is illustrated as a propeller-type fan, although other fans, such as a centrifugal fan, would typically be used. The fan housing 48 can enclose a fan motor, a heating element for heating the air delivered by the fan 46, and a control device (not shown) for operating the blower 42. The blower 42 can also comprise a cowl 54 enclosing the fan 46, and a grille 52 attached to the blower housing 44 over the blower 42. The grille 52 can be provided with inclined louvers and rotatably attached to the blower housing 44 to enable the direction of the airflow to be selected by rotating the grille 52.

The blowers 42 can be electrically connected to the power supply for the extraction cleaning machine 10. A user-operated control mechanism (not shown) well-known to a person of ordinary skill in the art can be incorporated into the cleaning machine 10 for selectively operating the blowers 42. For example, the control mechanism can comprise a well-known switching device (not shown) which can operate between an "off" position and one or more "on" positions. The switching device can utilize one or more toggle switches, a rotary switch, pushbuttons, or the like, to select a particular operational condition. For example, with the switching device placed in an "off" position, the blowers 42 will be placed in a deactivated condition. A first switch operating position can activate all blowers 42 for delivery of air to the surface to be cleaned extending along both sides of the cleaning machine 10. A second switch operating position can activate one set of blowers 42 on, for example, the left side of the cleaning machine 10 for delivery of air to the surface extending along the left side of the cleaning machine 10. A third switch operating position can activate the other set of blowers 42 on, for example, the right side of the cleaning machine 10 for delivery of air to the surface extending along the right side of the cleaning machine 10. Additional switch operating positions and/or controls can activate or deactivate the heating elements for selected blowers 42. Fan speeds can be selectively adjusted by other operating positions and/or controls.

The operation of the blowers 42 can also be operationally associated with the operation of the extraction cleaning machine 10. For example, the blowers 42 can be automatically activated when the vacuum and liquid delivery systems are operating. Alternatively, the blowers 42 can be independently activated. Thus, the vacuum and liquid delivery systems can be operated without the blowers 42 activated, and the blowers 42 can be activated without the vacuum and liquid delivery systems operating. In the latter situation, the extraction cleaning machine 10 can be selectively positioned on a wet surface and operated continuously as a blower to dry the surface after cleaning, similar to the use of conventional ventilating fans for drying the surface.

Figure 3:
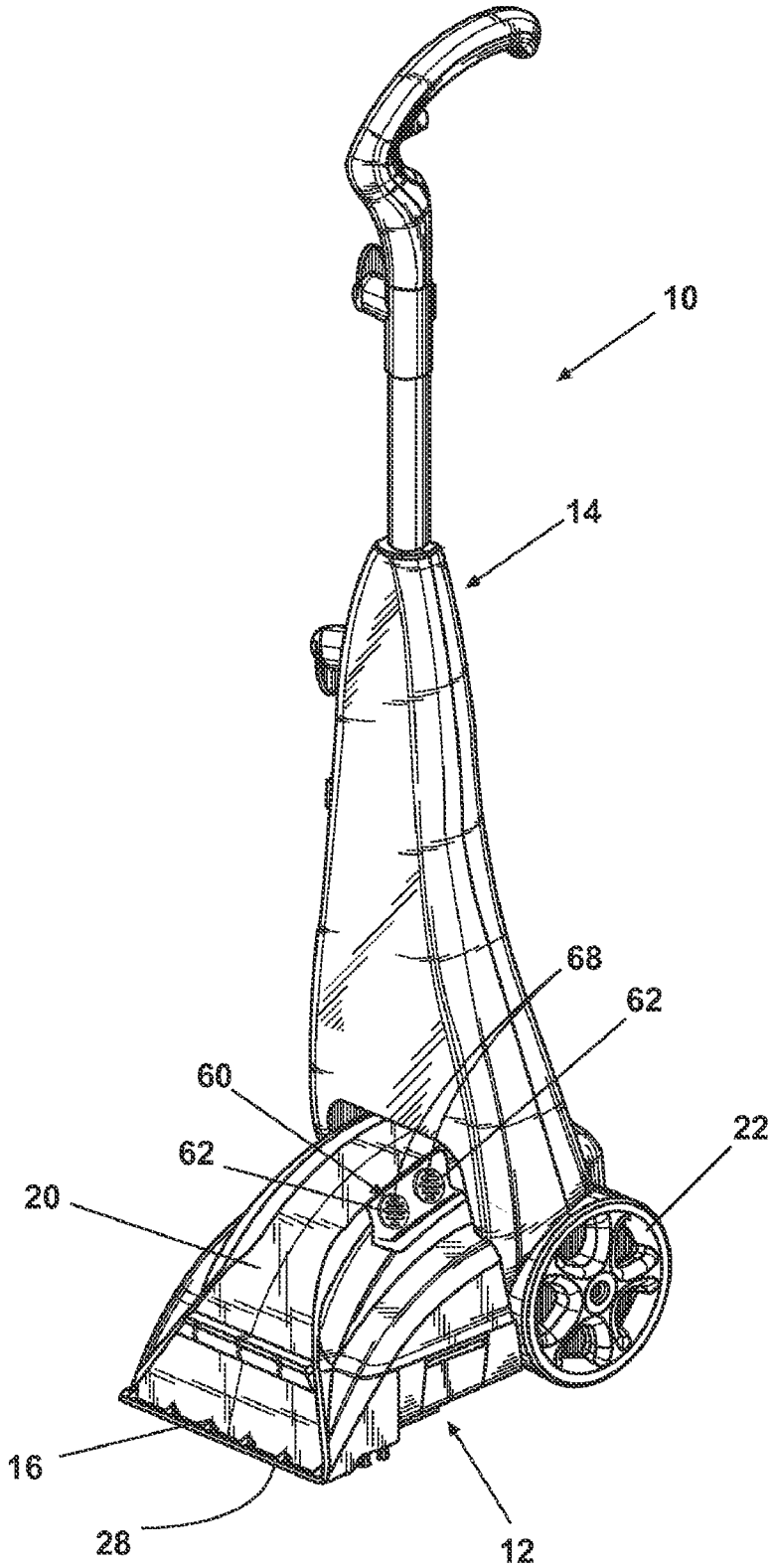
FIG. 3 is a perspective view of an upright extraction cleaning machine comprising a base module and a handle assembly, and a second embodiment of a blower assembly according to the invention.

FIG. 3 illustrates a second embodiment of the blower assembly 60 in which the blowers 62 are mounted in an upper portion of the housing 20. FIG. 3 illustrates a pair of blowers 62 mounted laterally on one side of the housing 20 for delivery of air laterally away from the extraction cleaning machine 10 in a first direction. It will be understood that an identical pair of blowers 62 is mounted on the opposite side of the housing 12 for delivery of air laterally away from the extraction cleaning machine 10 in a second, opposed direction.

Figure 4:
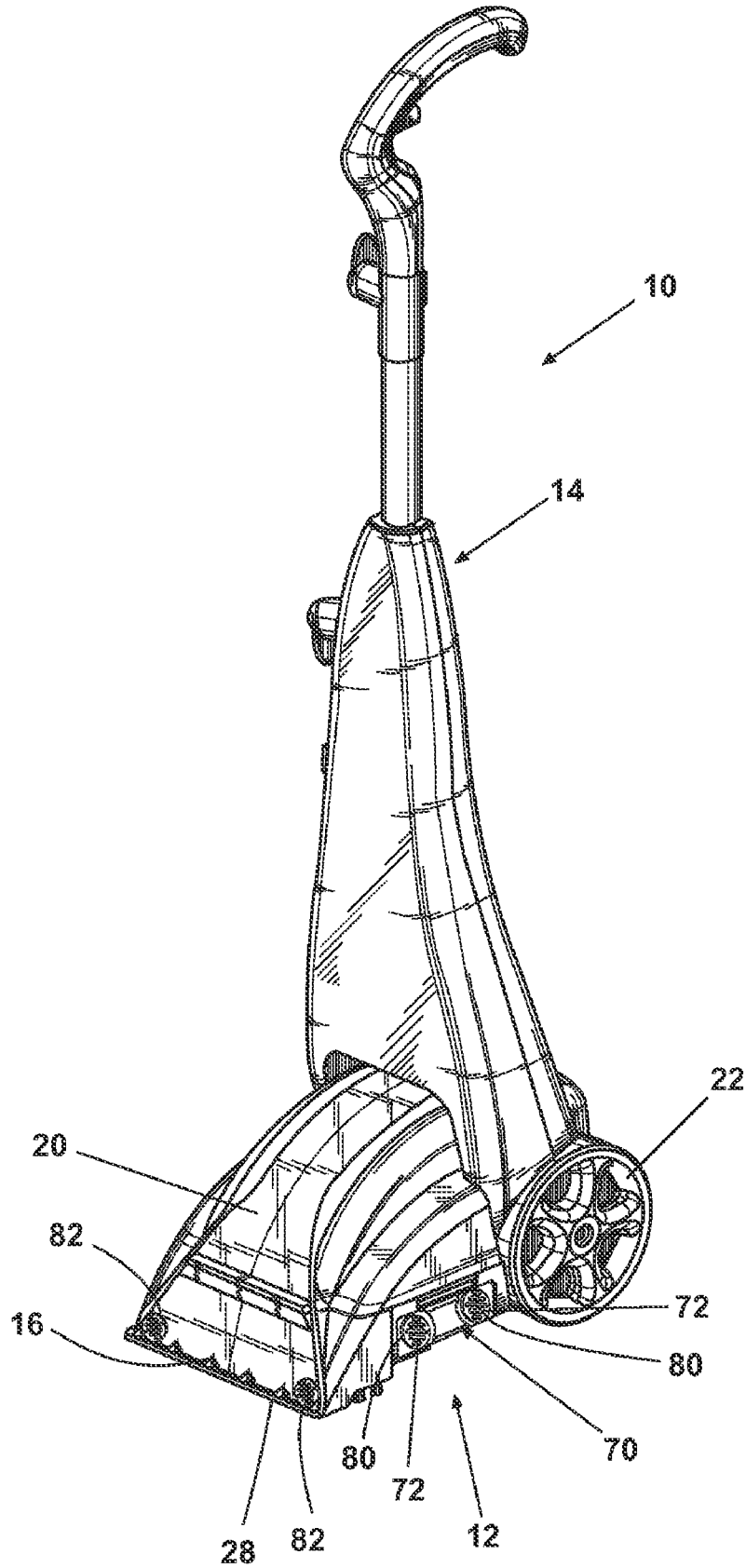
FIG. 4 is a perspective view of an upright extraction cleaning machine comprising a base module and a handle assembly, and a third and fourth embodiment of a blower assembly according to the invention.

FIG. 4 illustrates a third and fourth embodiment of the blower assembly 70 in which the blowers 72 are mounted in a lower portion of the housing 20. FIG. 4 illustrates a pair of blowers 72 mounted in one lateral wall of the housing 12 for delivery of air laterally away from the extraction cleaning machine 10 in a first direction transverse to the direction of movement of the cleaning machine. It will be understood that an identical pair of blowers 72 is mounted in the opposed lateral wall of the housing 12 for delivery of air laterally away from the extraction cleaning machine 10 in a second, opposed direction. It has been found that airflow along the surface to be cleaned from a blower assembly located at the surface generates much less noise than a blower which is elevated above the surface.

FIG. 4 further illustrates another set of blowers 82 that can be used in addition to or in lieu of the blowers 72. These blowers 82 are adapted to direct drying air in a direction of the movement of the cleaning machine 10 during the cleaning process.

Figure 5:
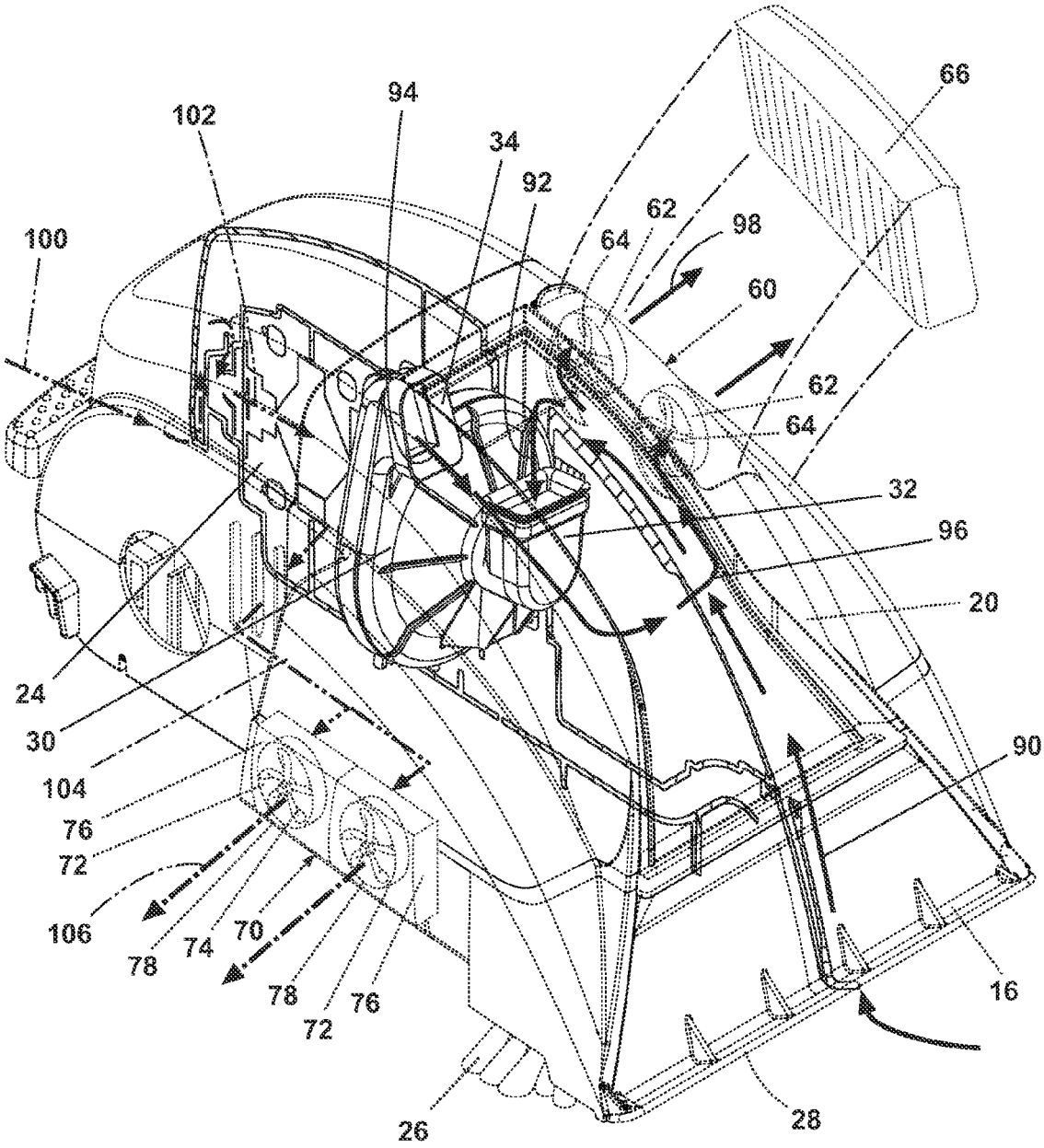
FIG. 5 is a phantom perspective view of the base module of FIG. 1 illustrating motor cooling air flow and working air flow through the base module and blower assemblies.

FIG. 5 illustrates in a single view the location and airflow associated with each embodiment. In the embodiment comprising the blower assembly 60, air discharged by fans 64 through a grille 66 originates with air vacuumed into the cleaning machine 10 through the vacuum inlet 28. Such air is referred to as "working air" and contains liquid removed from the surface to be cleaned which is separated from the air and retained in a reservoir in the extraction cleaning machine for later disposal. In a well-known manner, air, represented by the airflow vector 90, flows through the vacuum inlet 28 and into a vacuum blower inlet 32, represented by the airflow vector 92. Air is exhausted from the vacuum blower 90 through a vacuum blower outlet 34, as represented by the airflow vector 94, and to a conventional recovery tank (not shown) that separates liquid from air. Air exhausted from the separation process is delivered to the blowers 62 through suitable airflow conduits or channelways (not shown), as represented by the airflow vector 96. The air is discharged along the surface by the blowers 62, as represented by the airflow vector 98. It will be understood that the airflow generating portion of the blower assemblies 40, 60, 70, 82, 120 can be eliminated and the airflow can be generated by the vacuum blower 30 and using either working air or motor cooling air to dry the surface.

It will also be understood that air discharged from the blower assembly 60 can originate elsewhere, such as through one or more inlets in the housing 20 established specifically for providing air to the blower assembly 60, or as air originating as cooling air for the motor assembly 24. In FIG. 5, air discharged from the blower assembly 70 is illustrated as originating as cooling air for the motor assembly 24. Typically, cooling air for the motor assembly 24, represented by the airflow vector 100, is drawn into the housing 20 through one or more inlets in the housing 20. The air is routed through the motor assembly 24, represented by the airflow vector 102, and cools the motor assembly 24. The air is then routed through suitable conduits or channelways (not shown), represented by the airflow vector 104, to the blower assembly 70. The air is discharged along the surface by the blowers 72, as represented by the airflow vector 106.

Figure 6:
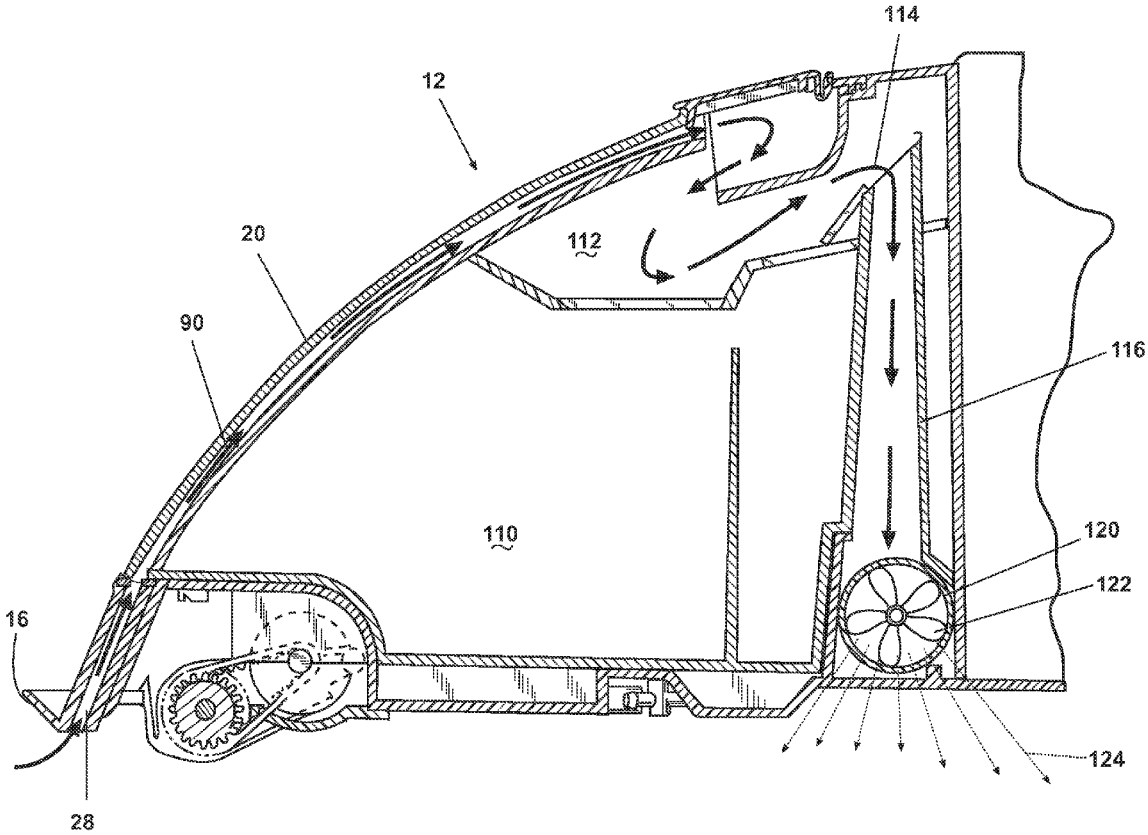
FIG. 6 is a sectional view of a base module comprising a fifth embodiment of a blower assembly according to the invention.

FIG. 6 illustrates a fifth embodiment in which the vacuum inlet 28 leads to a baffle chamber 112 where the vacuumed liquid is separated from the air and received in a recovery tank 110 for later disposal in a well-known manner. The baffle chamber 112 is fluidly connected to a standpipe 116. The standpipe 116 terminates in a blower assembly 120 comprising a fan 122 adapted to discharge air along the surface in a manner similar to the blower assembly 70 illustrated in FIG. 4. Air is drawn through the vacuum inlet 28, represented by the airflow vector 90, through the baffle chamber 112, represented by the airflow vector 114, through the standpipe 116 and out the blower assembly 120 along the surface, represented by the airflow vector 124.

Figure 7:
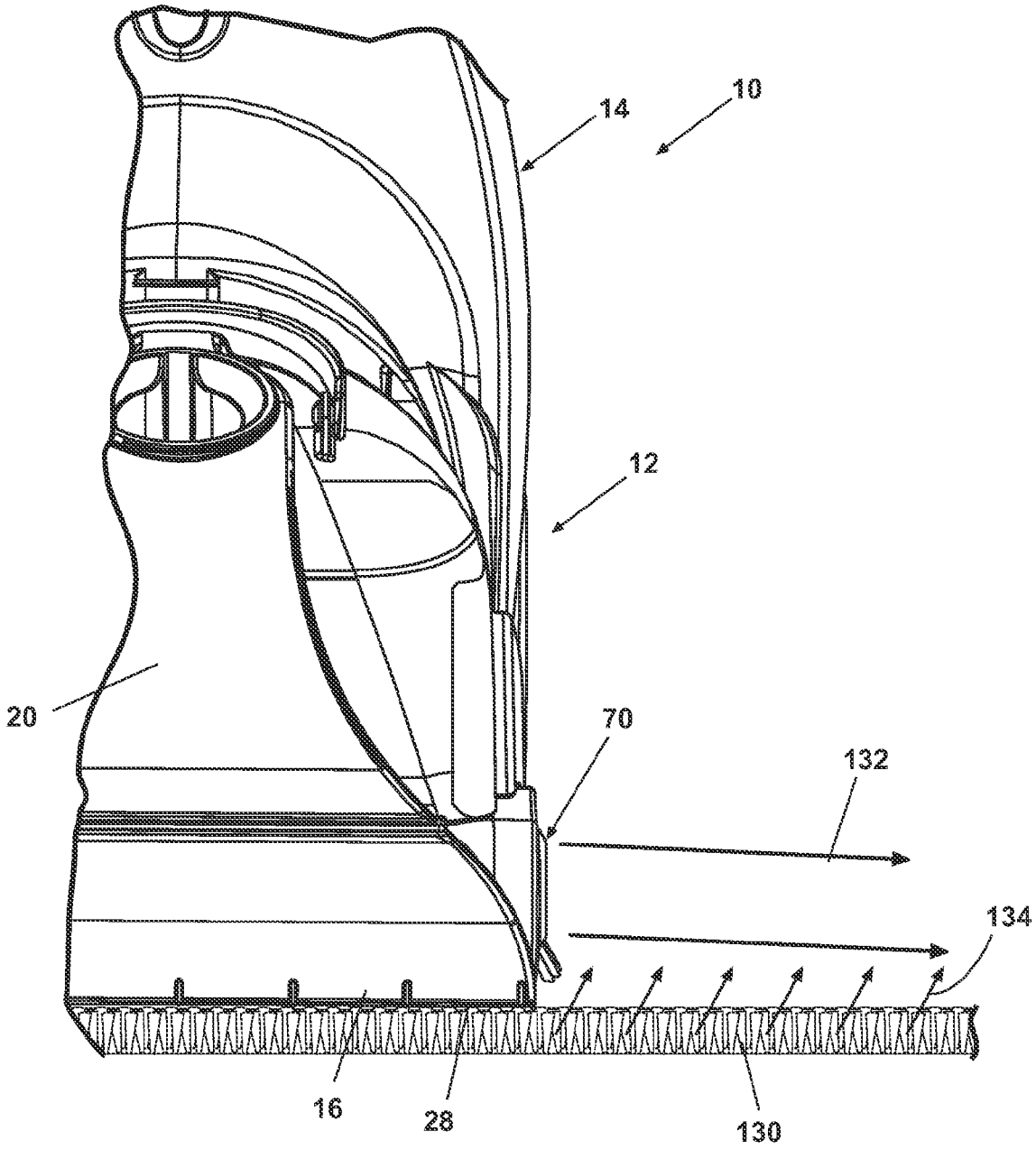
FIG. 7 is a partial front elevational view of the base module illustrated in FIG. 3 showing the migration of water from a surface under the influence of air flow from a blower assembly.

As illustrated in FIG. 7, airflow 132 over a wet carpet surface from any of the herein-described blower assemblies will accelerate the removal of moisture 134 from the wet carpet 130. The relatively high velocity of the airflow 132 will establish a forced convection current at the carpet 130 surface which facilitates the movement of moisture 134 out of the carpet 130 and into the ambient air.

The blower assemblies described and illustrated herein have been configured as delivering air laterally away from the extraction cleaning machine. However, blowers can also be configured to deliver air forward and rearward of the extraction cleaning machine, either in combination with the configurations described herein, or in substitution therefor. The greater the airflow, the better, however, the blower assemblies will have an airflow of 20-100 cubic feet per minute, typically 30 cubic feet per minute, to deliver air at a relatively high flow a distance of several yards from the extraction cleaning machine. Depending upon the distance from the extraction cleaning machine over which the air is to flow for drying the surface, the blower assembly airflow can exceed 100 cubic feet per minute. The blower assemblies can also have movable grilles mounted in a rotatable housing so that airflow can be focused or directed to selected locations away from the extraction cleaning machine. The blower assemblies can also be provided with air cleaning devices, such as filters or electrostatic precipitators, desiccant filters for dehumidification of the air, fragrance delivery packages for introducing fragrance into the air, timers for controlling the length of time the blower is operated, and the like. Additionally, the handle mounted blower assembly 40 illustrated in FIG. 1 can be configured with its own power supply, including a separate power cord, and controls to be removable from the extraction cleaning machine to be used as a stand-alone continuous use blower system.

The auxiliary high flow blower will accelerate the drying of cleaned, wet surfaces by the delivery of air at a high velocity tangentially across the surface, thereby accelerating the migration of moisture from the surface and shortening the drying time during which the surface is out of service. Dry ambient air can be utilized, as well as heated air. Heating of the air can be accomplished by dedicated heating elements in each blower assembly, or by utilizing cooling air from the motor assembly.

The invention has been described above with respect to an assemblage of blowers delivering the air over the surface to be dried. An embodiment illustrated in FIGS. 8-15 utilizes a plenum and fluidly coupled air outlets to deliver air laterally away from the extractor base module 12 over the surface without the use of blowers. The plenum can be utilized alone, or in combination with one or more previously described blower configurations.

Figure 8:
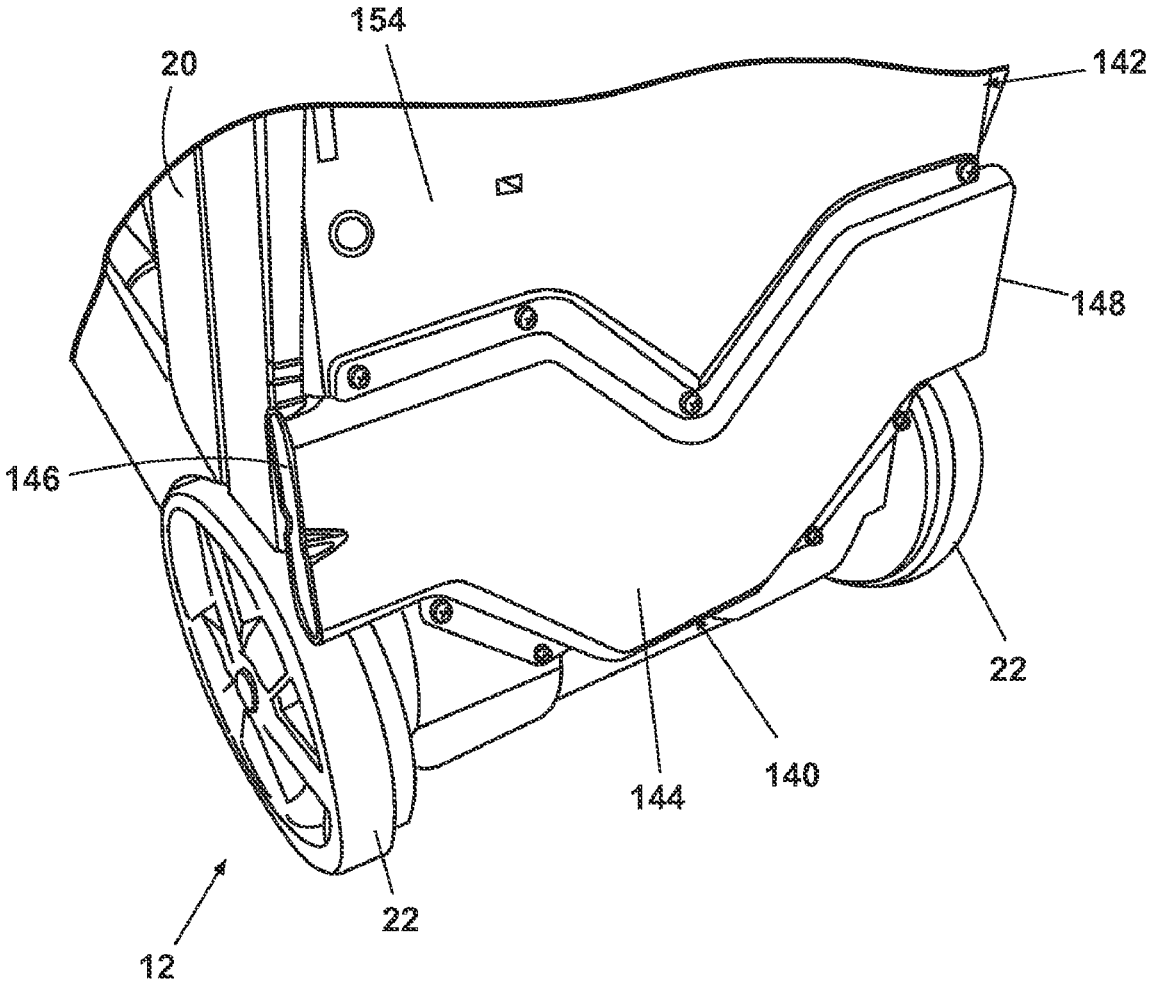
FIG. 8 is a perspective partial view of an upright extraction cleaning machine with a plenum mounted to an underside thereof, comprising a sixth embodiment of the invention.

FIG. 8 illustrates a base/plenum assembly 140 comprising the base housing 20 having a lower housing 142 with an attached plenum 144 configured to deliver air laterally away from the base housing 20 along the surface to be dried. The plenum 144 defines a somewhat V-shaped conduit terminating in a pair of coaxially aligned, laterally-opposed plenum outlet openings 146, 148.

Figure 9:
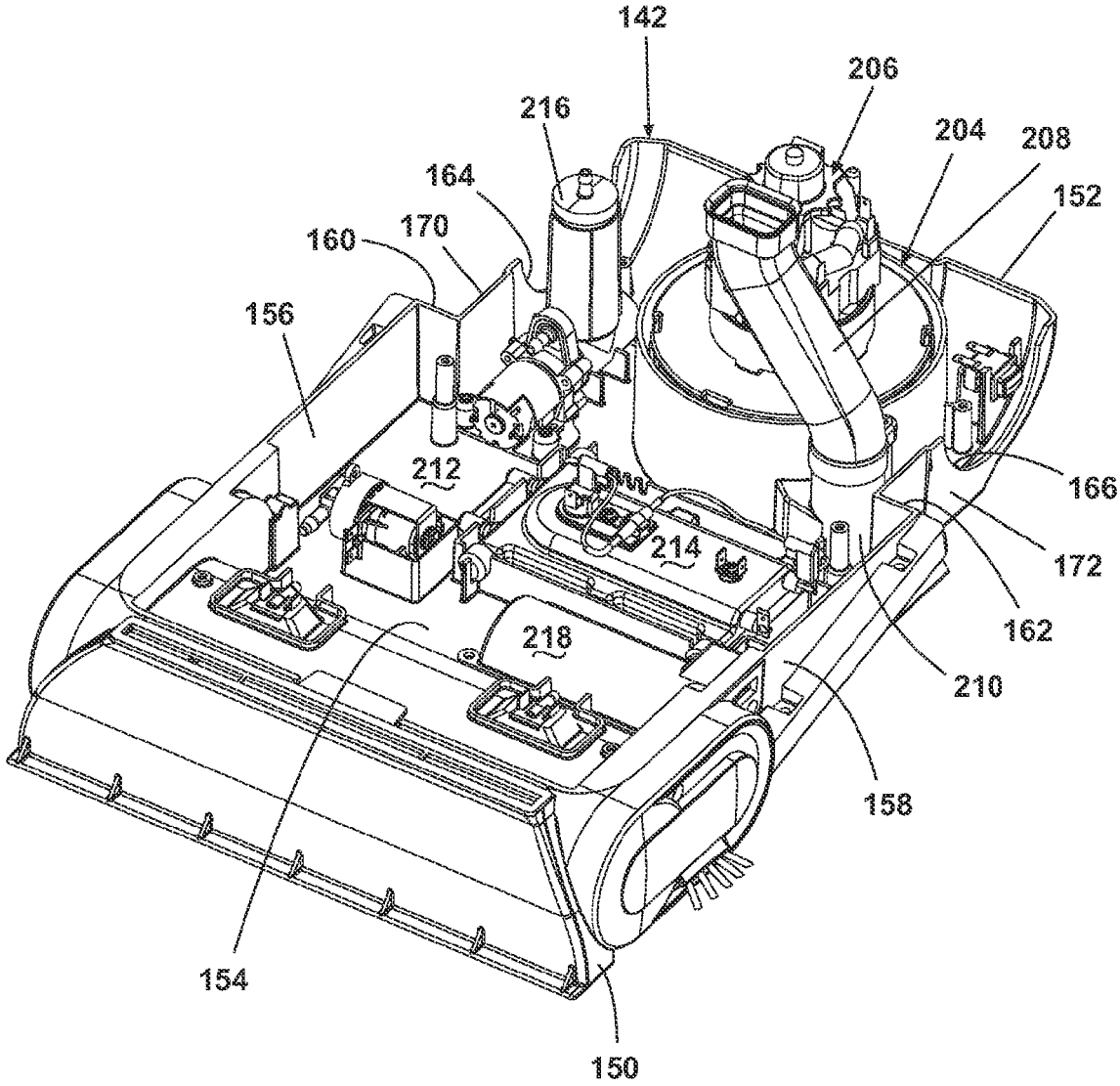
FIG. 9 is a perspective view from above of a base housing comprising a part of the upright extraction cleaning machine illustrated in FIG. 8, having powered components such as a motor and fan assembly, with portions removed for clarity.

FIG. 9 illustrates an extractor base module 12 comprising part of a surface cleaning apparatus, with portions removed to show the interior with selected components housed therein. The surface cleaning apparatus is described and illustrated in U.S. Patent Application Publication No. US2006/0288518 A1, dated Dec. 28, 2006, which is incorporated herein by reference in its entirety.

The extractor base module 12 comprises a lower housing 142 having a forward end 150 and a rearward end 152. A planar base wall 154 extends from the rearward end 152 to the forward end 150, and a pair of spaced side walls 156, 158 extends orthogonally along the side edges of the base wall 154 between the forward end 150 and the rearward end 152 to define a base housing cavity 212. The base housing cavity is provided with integral support structures such as a motor and fan assembly housing 204 for housing a motor and fan assembly 206, and support structures for housing and/or supporting other powered components such as a heater 214, a pump assembly 216, and an agitator motor 218, as well as other known extractor operational components. Each side wall 156, 158 transitions through a step wall 160, 162, respectively, to a wheel wall 170, 172, respectively, extending to the rearward end 152. Each wheel wall 170, 172 is penetrated by a wheel cutout 164, 166, respectively, associated with the drive wheels 22.

Figure 10:
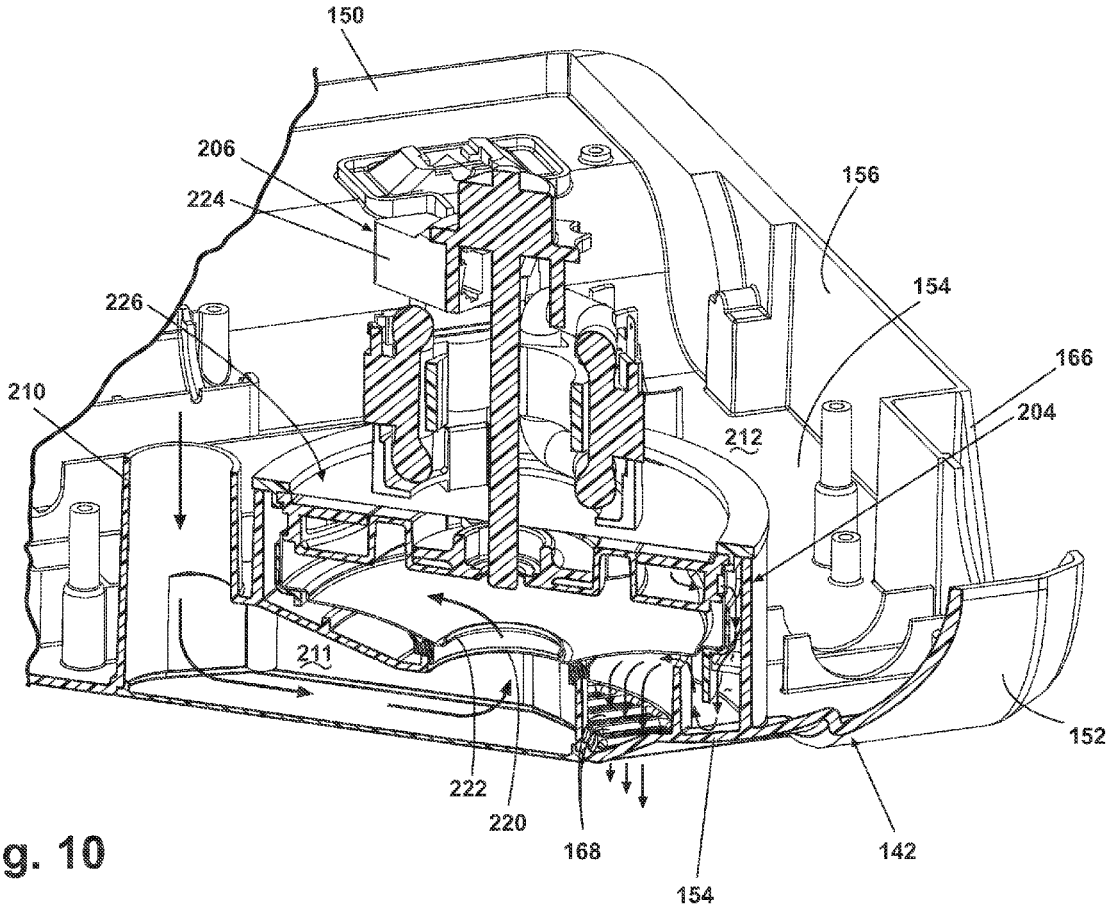
FIG. 10 is a sectional view of the motor and fan assembly of FIG. 9 illustrating airflow through the motor and fan assembly and out the base housing.

Referring also to FIG. 10, the motor and fan assembly housing 204 is fluidly coupled with a transfer conduit 208 through a motor and fan assembly inlet conduit 210 and a horizontal conduit 211, which opens into the motor and fan assembly housing 204 through a fan housing inlet 220. The motor and fan assembly housing 204 houses a fan motor 224 and a centrifugal fan 226. The fan 226 comprises a fan inlet 222 in coaxial fluid communication with the fan housing inlet 220.

As illustrated by the airflow vectors in FIG. 10, working air from the vacuum inlet at the front of the extraction cleaning machine is introduced into the transfer conduit 208 through suitable conduits, chambers, and channelways (not shown), and thence through the motor and fan assembly inlet conduit 210 and the horizontal conduit 211 into the centrifugal fan 226. The fan 226 then exhausts the air from the base housing cavity 212 through an exhaust outlet 168 in the base wall 154.

Figure 11:
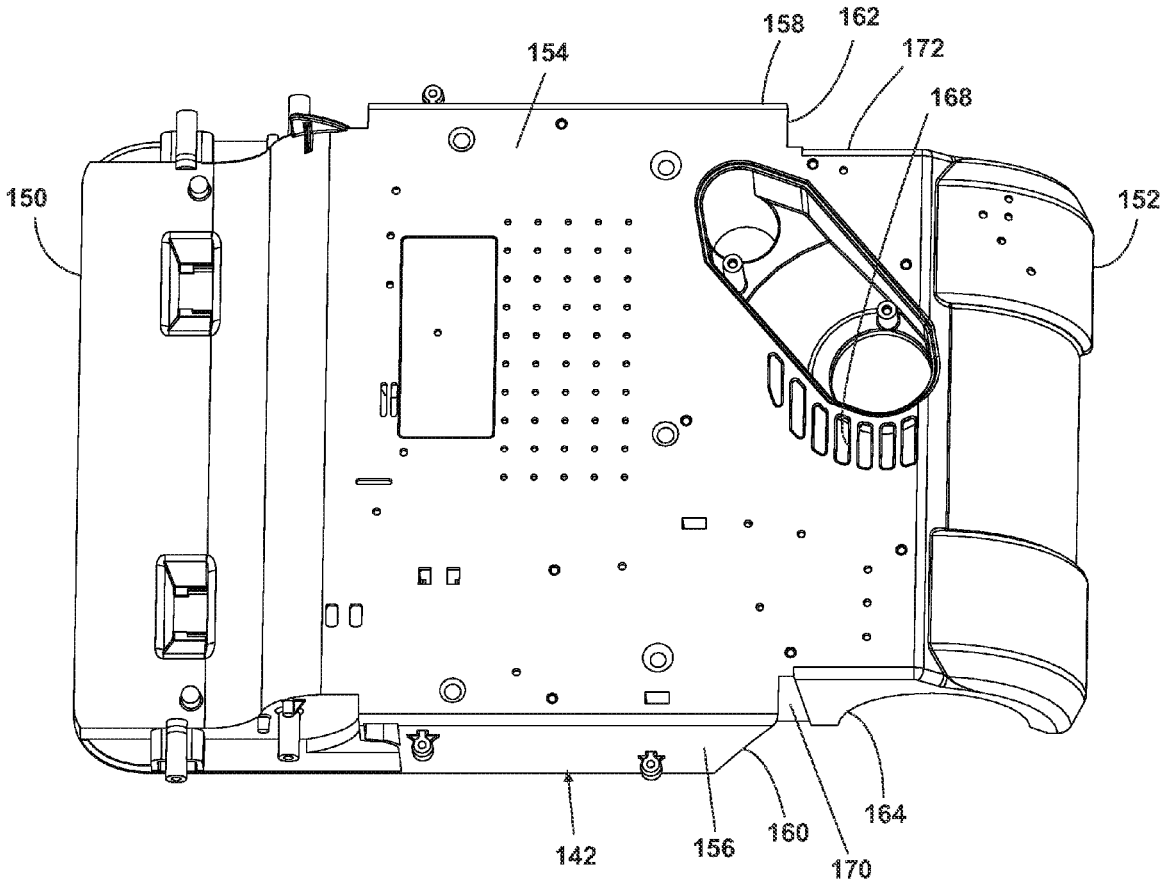
FIG. 11 is a perspective view from the underside of the base housing illustrated in FIG. 9.

FIG. 11 is a perspective view of the lower housing 142 with portions removed for clarity. The base wall 154 is penetrated by the exhaust outlet 168 configured for the exhaustion of working air from within the base housing 20.

Figure 12:
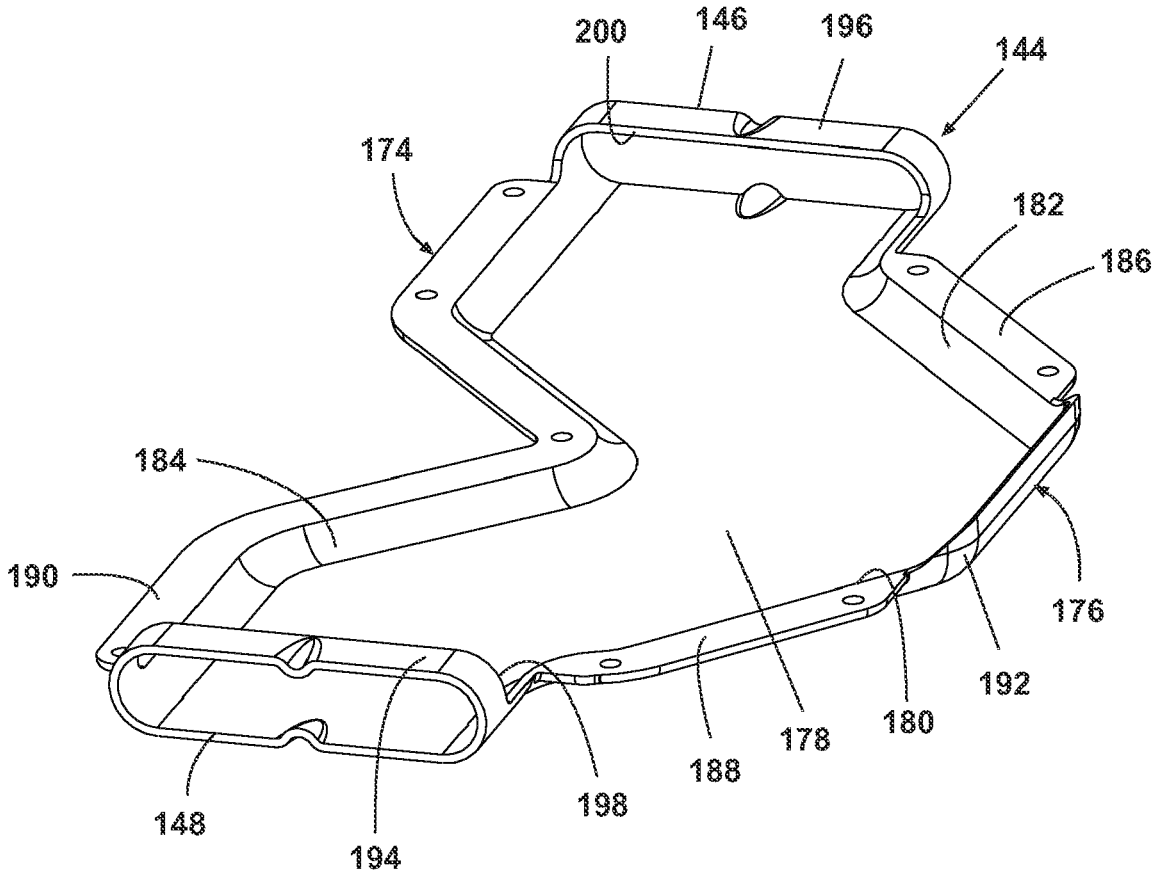
FIG. 12 is a perspective view of the plenum illustrated in FIG. 8.

FIG. 12 illustrates the plenum 144. The plenum 144 is a somewhat V-shaped body having a forward end 174, and a rearward end 176 corresponding to the vertex of the "V." The plenum 144 comprises a V-shaped planar bottom wall 178 transitioning through a pair of rear side walls 180, 182 to a pair of rear flanges 186, 188 extending laterally away from the side walls 180, 182 generally parallel to the bottom wall 178. The bottom wall 178 also transitions through a front side wall 184 to a generally V-shaped front flange 198 extending laterally away from and generally parallel to the bottom wall 178. The bottom wall 178 transitions at the rearward end 176 to an arcuate end wall 192.

A pair of outlet rings 194, 196 extends along the outer edges of the bottom wall 178 between the rear side walls 180, 182 and the front side wall 184 to define the plenum outlet openings 146, 148. The outlet rings 194, 196 define a somewhat oval-shaped inner edge 198, 200.

Figure 13:
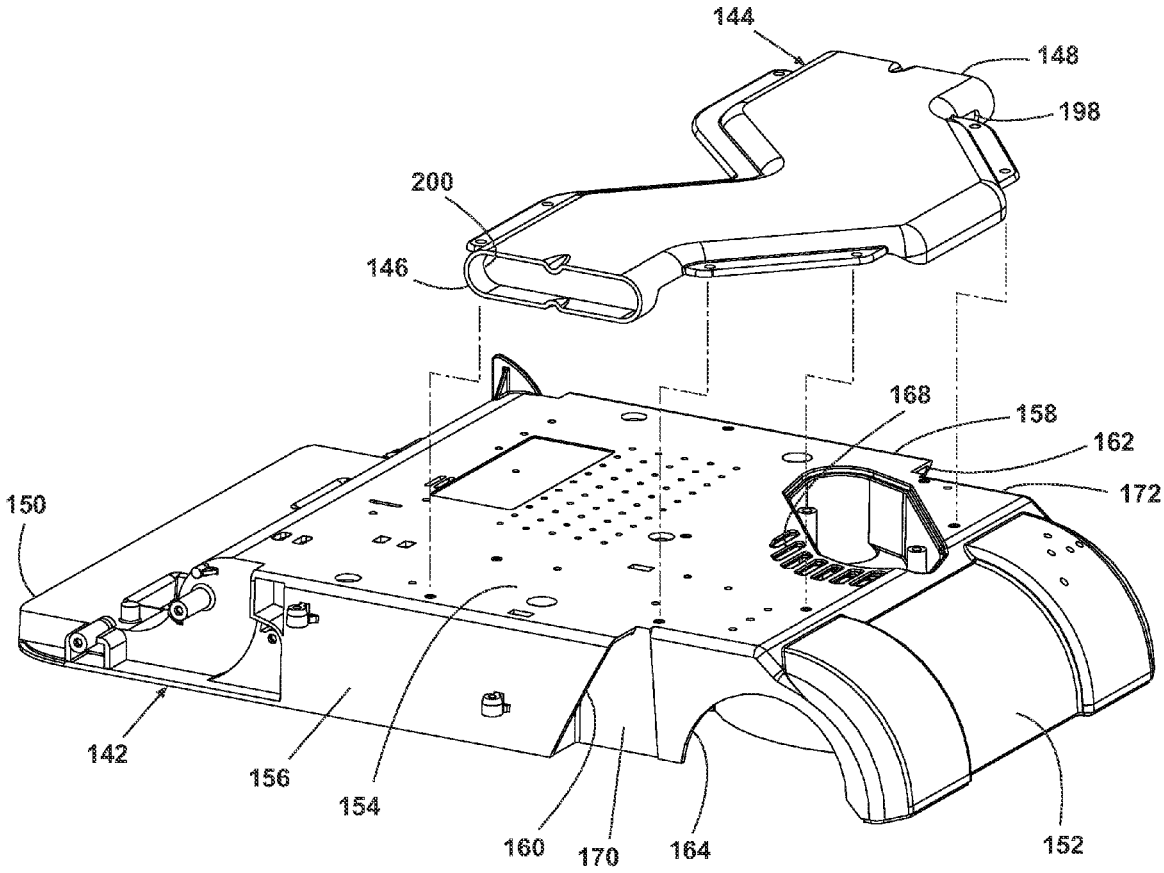
FIG. 13 is an exploded view of the base housing and plenum illustrated in FIG. 8.
Figure 14:
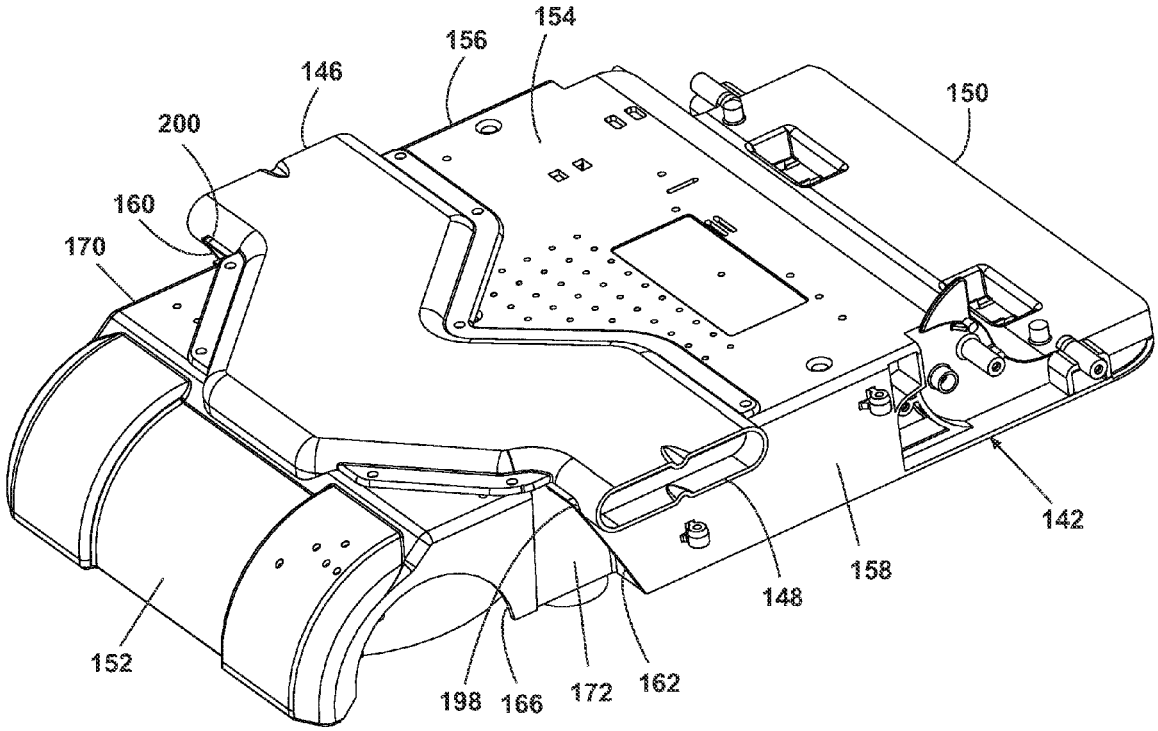
FIG. 14 is a perspective view of the base housing and plenum illustrated in FIG. 13 showing the plenum attached to the base housing.

Referring to FIG. 13, the shape of the plenum 144 is complementary to the shape of the base wall 154, and configured to extend over the exhaust outlet 168 so that the bottom wall 178 is spaced somewhat away from the base wall 154 of the base module 12. The flanges 186, 188, 190 engage the base wall 154 and are provided with apertures therethrough for securing the plenum 144 to the base housing 20 in a known manner, such as with threaded fasteners, rivets, pins, and the like. The arcuate wall 192 is configured to engage the lower housing 142 in order to provide a tight fit of the rearward end 176 of the plenum 144 with the lower housing 142. As illustrated in FIG. 14, the inner edges 198, 200 of the plenum outlet openings 146, 148 abut the side walls 156, 158 immediately forward of the step walls 160, 162 to provide an enclosed generally air-tight channelway from the exhaust outlet 168 through the plenum outlet openings 146, 148. A gasket or other suitable seal can be installed between the plenum 144 and the base housing 20 to enhance the air-tightness of the channelway.

Figure 15:
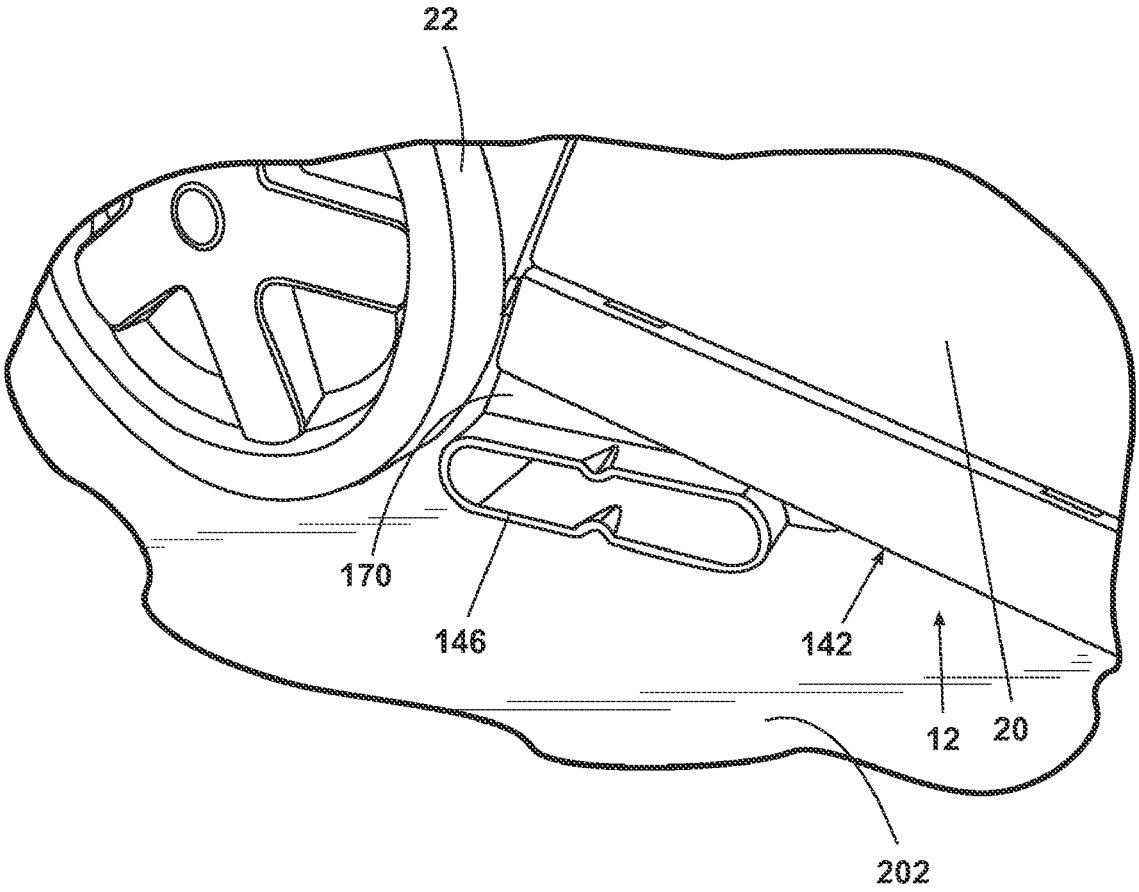
FIG. 15 is an enlarged perspective partial view of the upright extraction cleaning machine and attached plenum illustrated in FIG. 8 showing the plenum in an operable configuration.

As illustrated in FIG. 15, with the plenum 144 installed to the lower housing 142, exhaust air will be delivered from the exhaust outlet 168 laterally away from the base module 12 along a surface 202 immediately forward of the wheels 22. The spacing of the plenum bottom wall 178 from the base wall 154, and the lateral dimensions of the plenum 144 and plenum outlet openings 146, 148, can be selected to optimize the velocity of the air exiting the plenum outlet openings 146, 148.

The plenum 144 is preferably a structure that can be selectively attached to and removed from the lower housing 142 to utilize the extraction cleaning machine with or without the plenum 144. The plenum 144 can alternatively be integrated into the lower housing 142, with suitable controls, such as dampers, gates, louvers, valves, and the like, incorporated into the lower housing 142 to control the flow of air from the plenum outlet openings 146, 148. The plenum 144 can also be adapted for fluid communication with exhaust outlets in the base housing 20 utilized for exhausting cooling air used to cool powered components such as motors, pumps, heaters, and the like.

While the invention has been specifically described in connection with certain specific embodiments thereof, it is to be understood that this is by way of illustration and not of limitation. For example, the blowing of the air can take place exclusively of the normal operation of the extraction process with the use of the same equipment. The extraction machine can be parked in a room after the extraction, with only the blower operating to dry the cleaned surface of the room without operator control of the extractor. Reasonable variation and modification are possible within the scope of the forgoing disclosure and drawings without departing from the spirit of the invention which is defined in the appended claims.

What is claimed is:

1. A method of drying a surface the method comprising:

selecting a portable cleaning apparatus, including a base module with a suction nozzle, and a base module housing with an exhaust air outlet for discharging pressurized air, the suction nozzle including an opening located within the base module housing for extraction of air and liquid from the surface;

coupling a plenum with the exterior of the base module housing, the plenum including a plenum outlet opening located externally of the base module housing;

removing a mixture of air and liquid from the surface by applying suction to the surface through the suction nozzle while moving the base module along a first direction;

separating the air and liquid;

pressurizing the separated air; and exhausting the pressurized air through the exhaust outlet into the plenum, thence through the plenum outlet opening in a second direction transverse to the first direction along the surface away from the base module.

2. The method of drying a surface according to claim 1, and further comprising exhausting the pressurized air along the surface from a location spaced away from the suction nozzle.

3. The method of drying a surface according to claim 1, and further comprising passing the pressurized air toward the surface through the bottom of the base housing; before exhausting the pressurized air laterally along the surface.

4. The method of drying a surface according to claim 1, and further comprising heating the air by directing the air over a heat-generating powered component and exhausting the heated air along the surface.

5. The method of drying a surface according to claim 1, and further comprising separating the pressurized air in-to two streams wherein the exhausting step includes directing the two streams of pressurized air along two substantially opposite directions generally collinear with the second direction.

* * * * *